United States Patent [19]

Lapkewych

[11] Patent Number: 4,863,176

[45] Date of Patent: Sep. 5, 1989

[54] BALL THROW GAME

[76] Inventor: Ronald P. Lapkewych, 2293 Grayling, Hamtramck, Mich. 48212

[21] Appl. No.: 203,062

[22] Filed: Jun. 6, 1988

[51] Int. Cl.[4] ..... F41J 3/00

[52] U.S. Cl. ..... 273/346; 273/408

[58] Field of Search ..... 273/346, 408, 409

[56] References Cited

U.S. PATENT DOCUMENTS

| | | | |
|---|---|---|---|
| 2,214,486 | 9/1940 | Snyder | 273/409 |
| 3,300,216 | 1/1967 | Haecker | 273/408 X |
| 3,997,162 | 12/1976 | Scullin | 273/346 |
| 4,314,703 | 2/1982 | Grottola | 273/408 |

FOREIGN PATENT DOCUMENTS

| | | | |
|---|---|---|---|
| 3610137 | 10/1987 | Fed. Rep. of Germany | 273/408 |
| 855935 | 2/1940 | France | 273/409 |
| 981483 | 1/1965 | United Kingdom | 273/408 |
| 1489751 | 10/1977 | United Kingdom | 273/346 |
| 2034590 | 6/1980 | United Kingdom | 273/409 |
| 2069854 | 9/1981 | United Kingdom | 273/408 |
| 2086739 | 5/1982 | United Kingdom | 273/346 |

OTHER PUBLICATIONS

Playthings, 2-1976, Safe Dart Games, No. 202.
Playthings, 1-1977, p. 13, Velcro Fasteners.

*Primary Examiner*—Paul E. Shapiro

[57] ABSTRACT

A ball-throwing game that includes an upright (vertical) target board. The ball surface and target board surface are each formed of a fibrous material that comprises closely spaced miniature loops (or hooks). When the ball strikes the target board surface the miniature loops interlock with the miniature hooks so that the ball sticks onto the target board. The ball can be easily pulled off the board when desired. Target areas are defined on the target board by a rigid flat surfaced panel having openings. The exposed flat surface of the panel ensures that balls striking the exposed face of the panel are deflected away from the target surface.

1 Claim, 1 Drawing Sheet

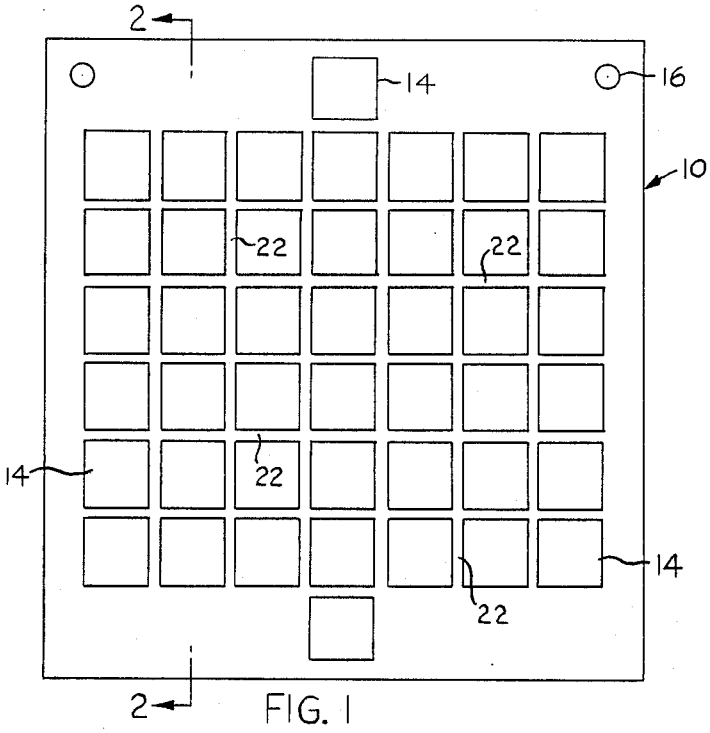
FIG. 1
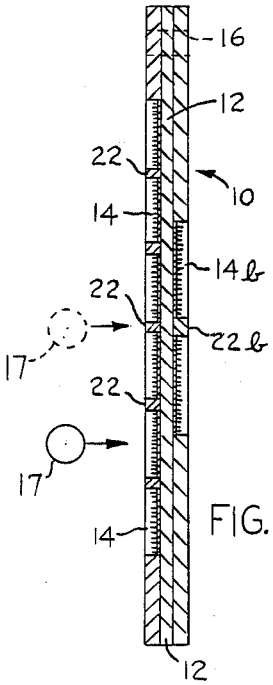
FIG. 2
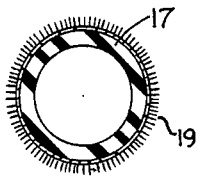
FIG. 3
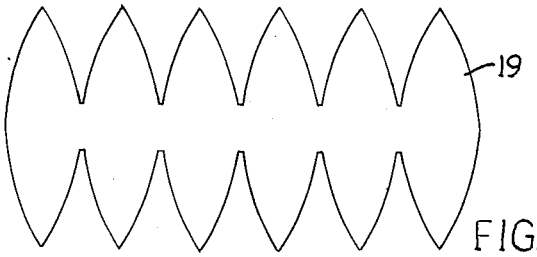
FIG. 4
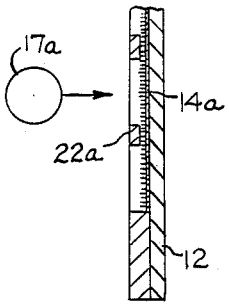
FIG. 6
FIG. 5
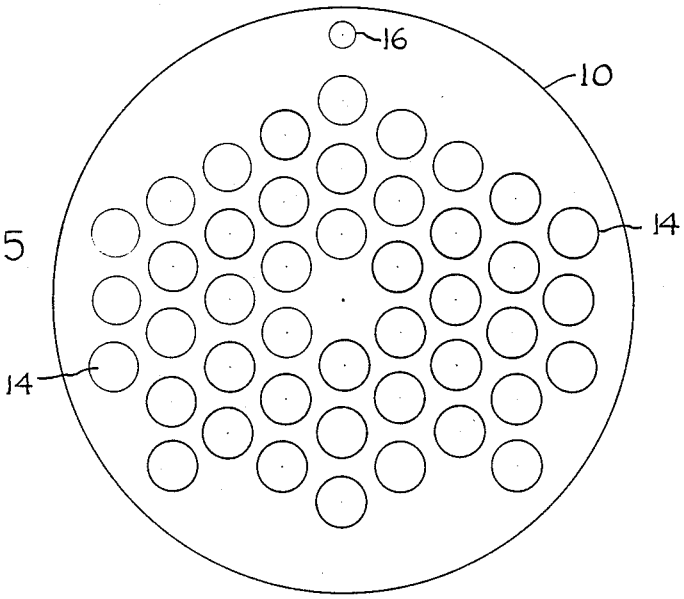

BALL THROW GAME

BACKGROUND OF INVENTION

My invention was devised primarily as an entertainment device for persons who are interested in selecting numbers in state lotteries. Such persons use various systems to select (predict) winning lottery numbers, e.g. birthdays, social security number, or wedding anniversaries. I envision a ball-throwing game as an entertaining (enjoyable) method for selecting lottery numbers. My new game can also be used in other ways, e.g. two or more players competing for the highest number of total points, or for the first player to reach a designated number of points. The game might also be used to teach children how to add or subtract numbers.

SUMMARY OF THE INVENTION

The invention relates to a game that comprises a target board subdivided into a number of discrete target areas (zones); each target area has a number associated therewith. The game also includes a number of spherical balls designated to be thrown at the target board. The ball surface and target board surface are formed of interlocking miniature hook and loop materials, whereby any ball thrown toward the target board will automatically stick onto the board surface (rather than bouncing off the surface or dropping off the board surface). The number of the discrete target area impacted by a thrown ball is credited to the person throwing the ball.

When the game is used to select numbers in state lotteries the board is subdivided into as many discrete spaces as the numbers used in the lottery, e.g. forty four numbers in the case of the lottery in the state of Michigan. Persons using the game apparatus throw as many balls at the target board as there are selections in the lottery, e.g. six selections in the case of the Michigan lottery.

One object of my invention is to provide a ball-throwing game that is safe for the participants; harmless balls are used instead of sharp pointed darts.

Another object is to provide a game wherein all of the discrete target areas on the target board are the same size and shape, whereby each numbered area on the board has approximately the same chance of being hit.

A further object is to provide a game wherein a thrown ball will not stick to portions of the board between any two adjacent numbered areas. This will eliminate indecision or argument as to which of the two numbered areas should be credited (selected) to that particular thrown ball.

Another object is to provide a ball-throw game where the game board is not penetrated or injured when the game is played (as is the case when darts are used).

THE DRAWINGS

FIG. 1 is a front elevational view of a game board embodying my invention.

FIG. 2 is sectional view on line 2—2 in FIG. 1.

FIG. 3 is an enlarged sectional view through a ball usable with the FIG. 1 game board.

FIG. 4 shows a blank sheet of fibrous material used as a covering for the FIG. 3 ball.

FIG. 5 is a front elevational view of another game board embodying my invention.

FIG. 6 is a fragmentary view in the same direction as FIG. 2, but illustrating a variant of the invention.

DESCRIPTION OF A PREFERRED EMBODIMENT OF THE INVENTION

FIGS. 1 and 2 illustrate a target board 10 that comprises a rigid flat panel 12 having forty four square strips 14 glued or otherwise secured to one of its faces. Each square strip occupies a separate discrete area on panel 12, such that each strip constitutes a separate target surface. Each square strip 14 has a different number (indicia) thereon, as by means of stencilling. The numbers range from "1" to "44", and correspond to the numbers used in one particular state lottery (Michigan). The numbered strips 14 are randomly located on panel 10, i.e. not in sequence.

Board 10 is designed to assume a vertical upright position, e.g. against a room wall. Suitable holes 16 are formed in the board for hanging the board on the wall. Six or more identical balls 17 are used with board 10. The person throws each ball against the board from some suitable distance, e.g. ten feet. The balls can be thrown underhand or overhand, at the person's discretion.

Each ball 17 has an outer surface comprised of a fibrous material made up of a large number of closely spaced miniature loops (or hooks). Each square strip 14 has an outer exposed surface comprised of a fibrous material made up a large number of closely spaced miniature hooks (or loops). The fibrous material hooks and loops are dimensioned for interlocking frictional engagement with one another, whereby the fibrous materials stick tightly together when they are pressed into contact. These fibrous materials are commercially avialalbe under the trandename VELCRO.

FIG. 2 shows a representative ball 17 during its flight toward board 10. The ball shown in full lines will stick on one of the discrete target areas (strips) 14. The ball shown in dashed lines will strike a subdivider mechanism 22 that separates one discrete target area from another. The ball shown in full lines will stick on the fibrous surface. The ball shown in dashed lines will be deflected away from the board surface. The exposed surface on mechanism 22 is preferably raised relative to the adjacent fibrous material surfaces to achieve its ball-deflection purpose.

The ball-deflecting action should eliminate disagreement or indecision in those cases where the ball simultaneously registers with edge areas of two adjacent discrete target areas. In such cases the ball will be rethrown until it sticks on one discrete target area.

FIG. 3 shows a representative ball 17 in somewhat greater detail than would be apparent from FIG. 2. The ball may be a small light hollow rubber ball having a fibrous material covering 19 thereon. Covering 19 includes the previously mentioned miniature loops (or hooks). Each square strip 14 is formed of a fibrous material that is made up of miniature hooks (or loops).

Covering 19 is a flexible material that can be glued to the outer surface of a ball 17. FIG. 4 shows one blank shape that covering 19 can take (in the flat state). The blank shape is wrapped around ball 17 to give the ball a fibrous exposed surface.

It will be seen from FIG. 2 that the transverse dimension of each discrete target area 14 is substantially greater than the diameter of each associated ball 17. The ball does not have to strike the exact center of a given target area in order to stick thereon. Most of the time the ball will strike an area that causes it to stick to the board rather than being deflected; this will avoid player annoyance that repeated deflections might generate.

FIG. 5 illustrates on a smaller scale another configuration that the game board might take. In this case the board is circular; also each discrete target area 14 is circular. The general mode of operation of the game board is the same in each case. With either configuration the player throws six balls at the target board (or one ball six times). He/she accumulates six lottery numbers corresponding to the numbers of the six target areas 14 that the balls hit. Should a ball be deflected by subdivider mechanism 22 the ball is rethrown.

FIG. 6 illustrates a slight variant of the invention wherein the individual square strips 14 are replaced by a single large panel 14*a*. A subdivider frame 22*a* overlies panel 14*a* to effectively subdivide panel 14*a* into discrete target areas. Frame 22*a* also shields selected areas of the panel against being hit by the associated ball 17*a*. The FIG. 6 arrangement operates in the same fashion as the FIG. 2 arrangement.

If desired, the game board can have fibrous material target areas on both of its faces. As shown in FIG. 2, the rear face of panel 12 has additional fibrous square strips 14*b* glued thereon. A subdivider mechanism 22*b* is associated with square strips 14*b* to achieve the same function as subdivider mechanism 22.

The number of square strips 14*b* can vary according to intended usage. In one contemplated arrangement there are ten square strips 14*b*, numbered from zero through nine. Three or four balls 17 can be thrown onto strips 14*b* to select numbers for the three digit lottery or four digit lottery The illustrated game boards are designed primarily as recreational entertainment devices in conjunction with state-run lottery operations. The game devices are not designed to improve one's chances of winning the lottery; rather they are viewed as entertainment devices for one's personal enjoyment in seeing how close he/she can come to picking the winning lottery number.

The game apparatus can be used for purposes other than selection of lottery numbers, e.g. two or more players seeking the highest total score (by adding up the numbers on strips 14 that are hit by balls 17). Preferably each discrete strip (or area) 14 on board 10 has the same size and shape. Also, the various discrete target areas are evenly spaced, whereby the chances for randomly hitting any particular target area are approximately the same; this makes the apparatus somewhat more useful (or attractive) for lottery number-selection purposes.

The drawings show particular forms and structures. It will be appreciated that variations and modifications are possible.

I claim:

1. A game comprising a target board adapted to assume a vertical upright position; and a plural number of spherical balls designed to be thrown at said target board;

said board having a target surface formed by a single sheet of a first fibrous material; each said ball having an outer surface formed of a second fibrous material; one of said fibrous materials being comprised of closely spaced miniature hooks; the other fibrous material being comprised of closely spaced miniature loops; said hooks and loops being dimensioned for interlocking frictional engagement with one another whereby when any one of the said balls is thrown onto the target board it will stick to the board surface;

and means subdividing said target surface into a number of evenly spaced separate discrete target surface areas, said subdividing means presenting an exposed surface that is raised relative to the adjacent fibrous material; said subdividing means comprising a subdivider frame overlying the target surface, said frame being a rigid flat-surfaced panel having openings therethrough outlining the aforementioned discrete target surface areas formed by the first fibrous material; the openings in the panel being spaced so that the intervening panel areas are narrower than the diameter of the associated ball; the panel being located in front of the target surface whereby a ball striking the exposed face of the panel will be ensured of being deflected away from the target surface;

each discrete target surface area being the same size and shape; each discrete target surface area having transverse dimensions greater than the diameter of each associated ball.

* * * * *